US011933125B2

(12) United States Patent
Maher et al.

(10) Patent No.: US 11,933,125 B2
(45) Date of Patent: Mar. 19, 2024

(54) RESETTABLE TELESCOPING PLUG RETRIEVING TOOL

(71) Applicant: Halliburton Energy Services, Inc., Houston, TX (US)

(72) Inventors: Peter Reid Maher, Lafayette, LA (US); Colby Munro Ross, Carrollton, TX (US); Jhess Menard, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/849,204

(22) Filed: Jun. 24, 2022

(65) Prior Publication Data

US 2023/0417115 A1 Dec. 28, 2023

(51) Int. Cl.
*E21B 23/04* (2006.01)
*E21B 33/12* (2006.01)
*E21B 37/08* (2006.01)

(52) U.S. Cl.
CPC ..... *E21B 23/042* (2020.05); *E21B 33/12* (2013.01); *E21B 37/08* (2013.01)

(58) Field of Classification Search
CPC ..... E21B 23/042; E21B 23/04
See application file for complete search history.

(56) References Cited

U.S. PATENT DOCUMENTS 1,555,811 A * 10/1925 Abercrombie ..... E21B 31/18 294/102.1
1,869,861 A * 8/1932 O'Bannon ..... E21B 31/18 294/86.32
3,074,482 A * 1/1963 Woodward ..... E21B 31/16 166/55.6
3,095,926 A * 7/1963 Rush ..... E21B 31/16 294/86.18
4,127,297 A * 11/1978 Dufrene ..... E21B 31/18 294/86.18
5,810,410 A * 9/1998 Arterbury ..... E21B 31/12 294/86.17
5,887,925 A * 3/1999 Arterbury ..... E21B 31/12 294/86.17
7,510,013 B2 3/2009 Kimpel
8,727,008 B2 * 5/2014 Krpec ..... E21B 37/00 166/99
9,903,180 B2 2/2018 Boutin et al.
10,151,162 B2 12/2018 Getzlaf et al.
(Continued)

OTHER PUBLICATIONS

International Search Report and Written Opinion for International Patent Application No. PCT/US2022/036249 dated Mar. 23, 2023.

*Primary Examiner* — Steven A Macdonald
(74) *Attorney, Agent, or Firm* — Scott Richardson; C. Tumey Law Group PLLC

(57) ABSTRACT

A plug retrieval tool includes a mandrel lowerable into a wellbore. A retrieval head is coupled to the mandrel for selectively latching onto a plug. A shroud is telescopically coupled to the mandrel about the retrieval head and moveable repeatedly between an extended position below the retrieval head for displacing debris on the plug and a retracted position for moving the retrieval head closer to the plug to latch onto the plug. A resistance mechanism provides a resistance to moving the shroud each time the shroud is moved toward the retracted position.

18 Claims, 5 Drawing Sheets

(56) References Cited

U.S. PATENT DOCUMENTS

| | | | | |
|---|---|---|---|---|
| 2014/0083677 | A1* | 3/2014 | Stormo | E21B 33/13 166/181 |
| 2014/0182858 | A1 | 7/2014 | Fenton | |
| 2016/0102525 | A1 | 4/2016 | Ross | |
| 2016/0160590 | A1 | 6/2016 | Ross | |
| 2016/0273287 | A1 | 9/2016 | Scott et al. | |
| 2016/0362960 | A1 | 12/2016 | Ross et al. | |
| 2017/0081938 | A1 | 3/2017 | Richards et al. | |
| 2019/0226301 | A1 | 7/2019 | Rahman et al. | |
| 2019/0264536 | A1 | 8/2019 | Abeidoh et al. | |
| 2020/0399971 | A1 | 12/2020 | Monteiro, Jr. | |
| 2022/0145728 | A1 | 5/2022 | Maher et al. | |

* cited by examiner

RESETTABLE TELESCOPING PLUG RETRIEVING TOOL

BACKGROUND

Wells are drilled to recover valuable hydrocarbons, such as oil and gas, from subterranean formations. To construct a well, a borehole is typically drilled to a desired depth using a drill bit at the end of a long, tubular drill string. Once the wellbore is drilled, the well must be completed to prepare the well for production of hydrocarbons. Completions operations may generally include, for example, reinforcing portions of the wellbore with metal casing, installing production tubing downhole, and perforating and/or stimulating a production zone to enhance the flow of hydrocarbons.

Completion operations can require plugs to be installed in packers while additional work is performed above, such as perforating or formation stimulation. This can result in debris, sometimes in large quantities, accumulating on top of the packer plug. When retrieving the plug to allow access to zones below the packer, this debris can be difficult to remove with a conventional plug retrieval tool. The debris may prevent the retrieval tool from reaching the retrieving head of the plug, resulting in a failed attempt to retrieve the plug.

BRIEF DESCRIPTION OF THE DRAWINGS

These drawings illustrate certain aspects of some of the embodiments of the present disclosure and should not be used to limit or define the method.

DETAILED DESCRIPTION

A resettable telescoping plug retrieving tool and method are disclosed. In any of a variety of configurations, the tool may include a shroud concentrically disposed about a mandrel that can be axially moveable repeatedly between an extended (e.g., run-in) position and a retracted position. In the extended position, the shroud may be used to displace any debris accumulated on the top of a plug to be retrieved. For example, a lower end of the shroud may be used to physically displace debris via axial and/or rotational movement of the shroud against the debris. A washout fluid may be flowed down through the mandrel to wash out loosened debris. When moved to the retracted position, a retrieval head on the mandrel may be used to latch onto the plug for removing the plug from the wellbore. The tool is resettable axially, e.g., back to the original run-in condition, in case a first attempt to latch onto the plug is unsuccessful. Any number of attempts can be made to latch on to the plug without having to trip the plug retrieval tool out of the wellbore, manually replace broken shear pins, or other intervention.

Movement of the shroud between the extended and retracted positions may be resisted by a resistance mechanism. In some configurations, the resistance is provided by constraining flow of fluid through a flow port. The resistance may be controlled using directional valves, for example. The amount of resistance in each direction may be controlled, for example, by using one or more higher-pressure valves providing the resistance when moving the shroud toward the retracted position and one or more lower-pressure valves providing a lesser resistance when moving the shroud to the extended position. A check valve may be used to control movement of the shroud in one direction, such as to require a threshold level of setting force to extend the shroud. A metering valve may be used to dampen movement of the shroud to the retracted position. The ability to reset the tool fully without intervention or tripping out of the well and to make multiple attempts to retrieve the plug saves time and cost.

Figure 1:
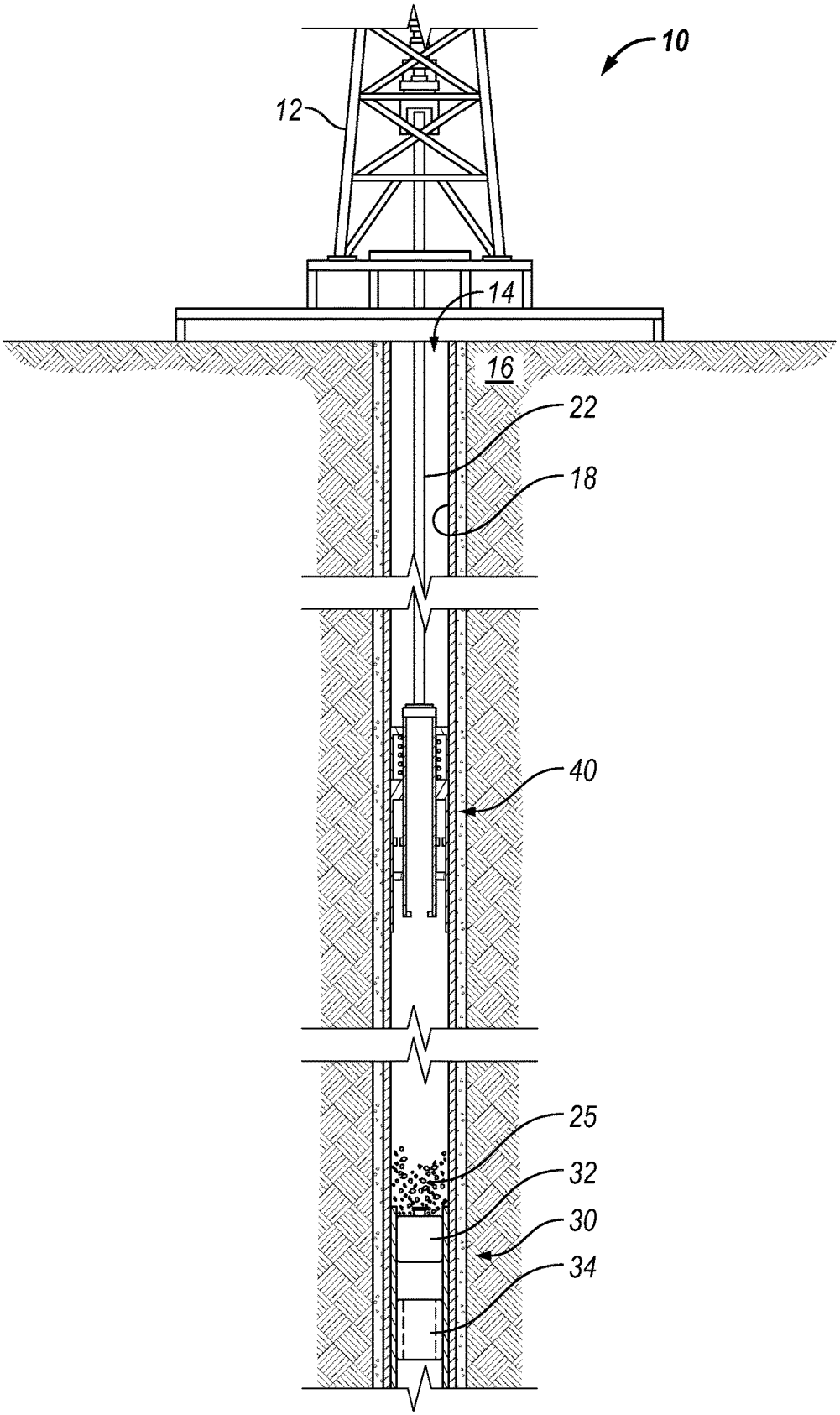
FIG. 1 is an elevation view of a representative well site in which a plug retrieval tool may be used for removing a plug from a wellbore sealing device.

FIG. 1 is an elevation view of a representative well site 10 in which a plug retrieval tool may be used for removing a plug 32 from a wellbore sealing device 30 according to aspects of the present disclosure. The well site 10 is simplified for discussion purposes, and is not to scale. While FIG. 1 generally depicts a land-based operation, those skilled in the art would readily recognize that the principles described herein are equally applicable to operations that employ floating or sea-based platforms and rigs, without departing from the scope of the disclosure. A service rig 12 extends over and around a wellbore 14. The service rig 12 may comprise a drilling rig, a completion rig, a workover rig, or the like. In some embodiments, the service rig 12 may be omitted and replaced with a standard surface wellhead completion or installation, without departing from the scope of the disclosure. The wellbore 14 has been drilled into a subterranean formation 16 and lined with a casing 18 held into place by cement 20. In some embodiments, the wellbore casing 18 may be omitted from all or a portion of the wellbore 14 and the principles of the present disclosure may alternatively apply to an "open-hole" environment. Although shown as vertical, directional drilling techniques may be applied such that the wellbore 14 includes any number of horizontal, vertical, slant, curved, and other types of wellbore geometries and orientations.

The wellbore sealing device 30 is more specifically a packer in this example. The packer has an elastomeric sealing element 34 for sealing an annulus defined between an OD of the packer 30 and an ID of the casing 18 or wellbore surface. The plug 32 is removably disposed in the packer 30 for blocking flow through the packer 30. For example, the packer 30 may be used to close the wellbore 14 above a production zone during a hydraulic fracturing (fracking) or wellbore stimulation procedure. The packer 30 may remain in place and the plug 32 later removed with the retrieval tool 40 to re-establish flow through the packer 30, such as for production fluids. Debris 25 may often accumulate as a result of fracking, stimulation, perforating, and other wellbore operations.

The plug retrieval tool 40 is depicted being lowered into the wellbore 14 toward the plug 32 on a conveyance 22 that extends from the service rig 12. The conveyance 22 may include any suitable apparatus for conveying wellbore sealing device into a wellbore, including but not limited to be a tubing string, coiled tubing, wireline, slickline, or the like. The conveyance 22 may include conduit for conveying fluids and/or electrical transmission lines for conveying electrical power and/or data signals. The conveyance 22, the plug retrieval tool 40, and optionally other tools supported on the conveyance 22 may be collectively referred to as a work string or tool string. As further discussed below, the plug retrieval tool 40 in any of its configurations may be operated to displace debris accumulated above the plug 32 and to then remove the plug 32 from the packer 30.

Figure 2C:
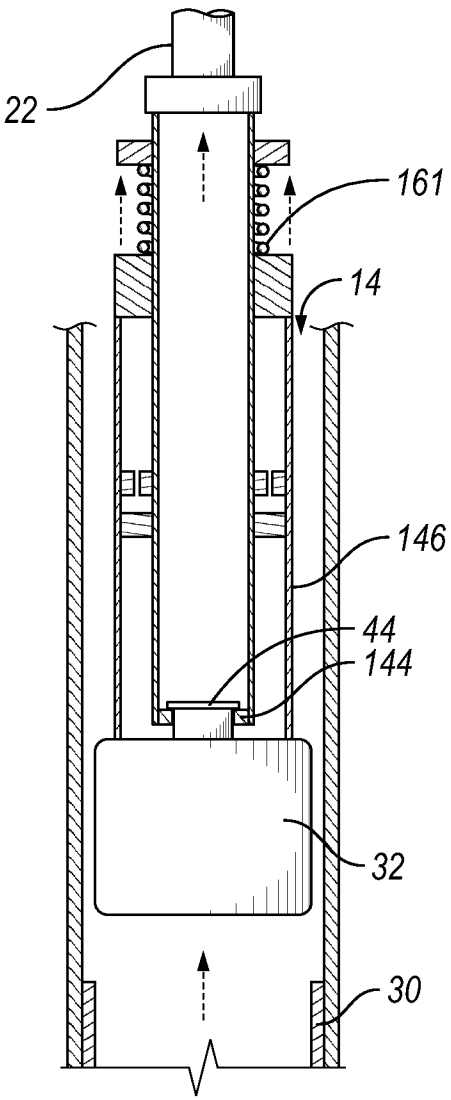
FIG. 2C is a schematic side view of the plug retrieval tool of FIGS. 2A and 2B with the plug being retrieved from the wellbore.
Figure 2B:
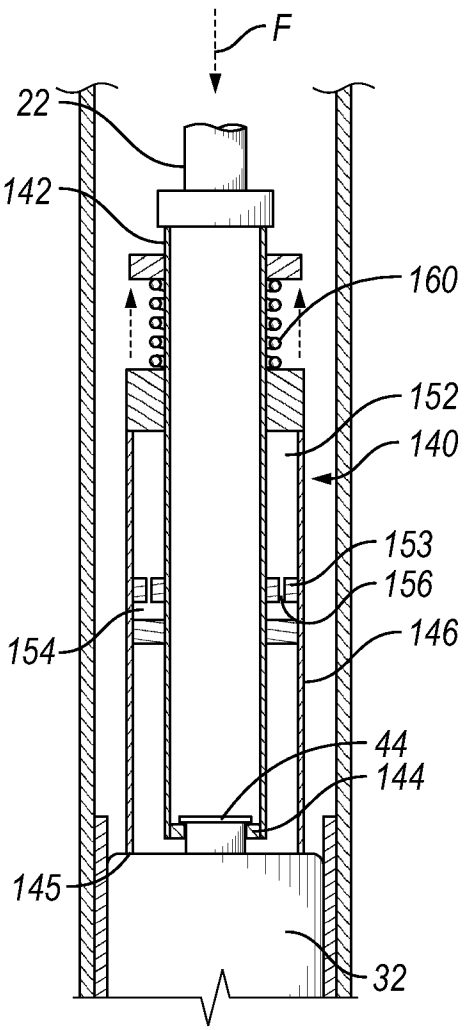
FIG. 2B is a schematic side view of the plug retrieval tool of FIG. 2A with the shroud retracted for attempting to latch onto a plug.
Figure 2A:
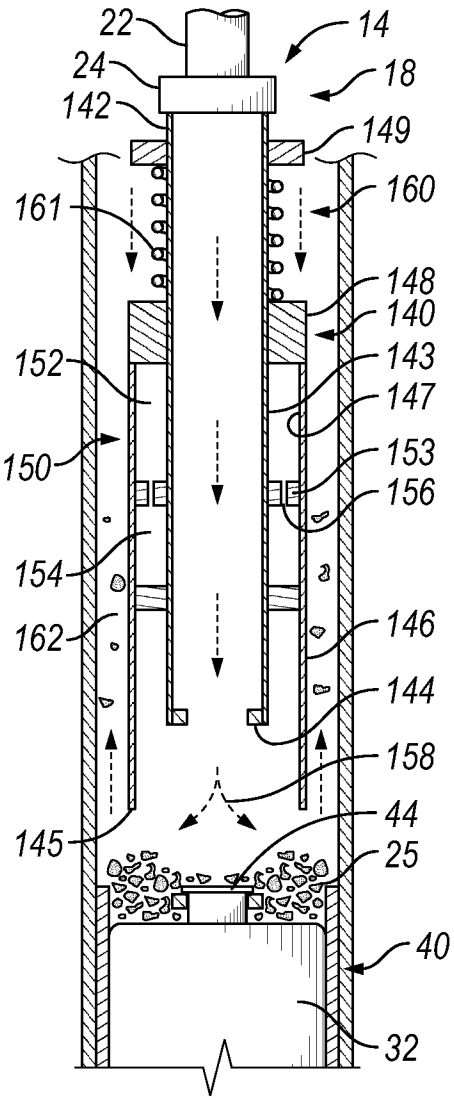
FIG. 2A is a schematic side views of a plug retrieval tool with a shroud extended for displacing debris.

FIGS. 2A-2C are schematic side views of a plug retrieval tool 140, according to an example configuration, operated to remove the plug 32 from the wellbore 14. In FIG. 2A, the plug retrieval tool 140 is positioned over the plug 32 with a shroud 146 extended to help displace debris 25 on the plug 32. The shroud 146 is carried on a mandrel 142 that is lowerable into the wellbore 14 on the conveyance 22. Any suitable connection 24 is made between the mandrel 142 and the conveyance 22, such as a threaded connection, so that the plug retrieval tool 140 is suspended by the conveyance 22 from the mandrel 142 and can be lowered into and subsequently removed from the wellbore 14. Non-limiting examples of connections may include internal flush (IF) drill pipe connections, connection standards prescribed by the American Petroleum Institute (API) or the European Union (EU), non-upset (NU) connections or various premium or proprietary thread connections. A retrieval head 144 is coupled to a lower end of the mandrel 142 for selectively latching onto the plug 32. Any suitable mechanism could be provided for the retrieval head to latch onto the plug 32. The plug 32 is schematically depicted, by way of example, as including a lug 44, which is a feature that sticks out from the main part of the plug 32 and can be used for lifting and/or carrying the plug 32. A lug could resemble what is shown in the figure, but it is not required to. Other, non-limiting examples of suitable mechanisms by which a retrieval head may latch onto a plug include a collect connection, radially moveable dogs, a fishing neck such as a straight OD fishing neck that is engaged by an overshot pulling tool, or an internal fishing neck that could be engaged with internal fishing tools. The debris 25 accumulated on top of the plug 32 may interfere with or otherwise prevent the retrieval head 144 of the plug retrieval tool 140 from latching onto the plug, and must first be removed.

The shroud 146 is telescopically coupled to the mandrel 142 about the retrieval head 144, such that the shroud 146 is moveable repeatedly between the extended position (FIG. 2A) for displacing the debris 25 and a retracted position (to be discussed in FIG. 2B) for the retrieval head 144 to latch onto the plug 32. In this example, the shroud 146 is concentric with the mandrel 142, and is axially moveable with respect to the mandrel 142, such as by sliding along a mandrel OD 143 of the mandrel 142. A splined or keyed interface (not expressly shown) between the shroud 146 and mandrel 142 may be provided to transfer torque or rotation while allowing this relative axial movement.

A resistance mechanism generally indicated at 150 provides resistance to the axial movement of the shroud 146. The resistance mechanism 150 provides the resistance each time the shroud is moved toward the retracted position. The resistance mechanism 150 may also provide resistance each time the shroud 146 is moved toward the extended position of FIG. 2A. The magnitude of the resistance may be different when moving the shroud toward the retracted position than when moving the shroud toward the extended position. Examples of resistance mechanisms include valves, although a resistance mechanism according to the disclosure is not strictly limited to valves. Any of a variety of resistance elements may be incorporated, such as a fluid-based damper to resist the flow of a fluid from one chamber to another. In this example, the resistance mechanism 150 more specifically includes first and second fluid chambers 152, 154 defined between the mandrel OD 143 and a shroud ID 147 of the shroud 146 with a flow port 156 allowing constrained flow therebetween. The flow port could be any fluid passage, including but not limited to an annular flow port or one or more circumferentially spaced ports. Although not strictly required, the mandrel OD 143 and shroud ID 147 are generally circular and the fluid chambers 152, 154 defined therebetween are annular and generally circular as a result. The annular fluid chambers 152, 154 may be continuous circumferentially, fully encircling the mandrel 142. However, alternate embodiments could be constructed wherein the fluid chambers 152, 154 do not extend fully circumferentially about the mandrel 142, such as one or more circumferentially spaced annular chambers that each extend circumferentially along just a portion (i.e., not a full 360 degrees) of the annulus defined between the mandrel OD 143 and shroud ID 147. The resistance mechanism 150 may operate in part by controlling the flow of fluid between the fluid chambers 152, 154 through the flow port 156.

A valve plate 153 separates the first and second fluid chambers 152, 154 and defines or include the flow port 156. The valve plate 153 may function in some respects as a bulkhead to separate first and second fluid chambers, but allowing for some limited, controllable flow therebetween via the flow port 156. Some combination of valves may be provided on the valve plate 153 to resist flow in one or both directions. Higher-pressure valves may be used to resist flow to a greater extent than comparatively lower pressure valves. In some examples, higher-pressure valves are used to resist movement to the extended position and lower pressure valve are used to resist movement to the retracted position, so that less force is required to move to the extended position than to the retracted position. In at least some configurations, the controllable flow is provided by one or more higher-pressure valves arranged on the valve plate 153 such that flow from the second fluid chamber 154 to the first fluid chamber 152 is constrained through the higher-pressure valves when moving the shroud toward the retracted position. The valve plate 153 may also include one or more lower pressure valves arranged on the valve plate 153 such that flow from the first fluid chamber to the second fluid chamber passes through the lower-pressure valve(s) when moving the shroud 146 back toward the extended position. The various valve(s) may define the flow port(s) and provide fluid resistance to resist movement of the shroud 146 with respect to the mandrel 142.

One or both of a mass and a biasing member may be provided to help move the shroud 146 toward the extended position, such as when lifting up on the mandrel 142 or suspending the plug retrieval tool 140 from the conveyance 22 by the mandrel 142. A biasing member 160 in this example comprises a spring 161 disposed between respective stops 148, 149 on the shroud 146 and the mandrel 142. The shroud 146 may also have a mass sufficient to help urge the shroud 146 to the extended position when the plug retrieval tool 140 is suspended by the conveyance 22 from the mandrel 142. In other configurations the shroud 146 may be weighted or designed with a sufficient mass that the mass of the shroud 146 is sufficient to move the shroud 146 toward the extended position.

In the extended position of FIG. 2A, the shroud 146 extends below the retrieval head 144, so the lower end of the shroud 146 is ahead of the retrieval head 144 as the plug retrieval tool 140 is lowered toward the plug 32. The shroud 146 in this extended position may thereby protect to some extent the retrieval head 144 or prevent it form getting fouled with the debris 25. The shroud 146 in this extended position can be used to mechanically displace the debris 25 via mechanical contact between the shroud 146 and the debris 25 before moving the retrieval head 144 closer to the plug 32 for removal. For example, a lower end 145 of the shroud 146 may be used to displace the debris 25 via axial and/or rotational movement of the shroud 146 (or whole plug retrieval tool 140) in contact with the debris 25. The lower end 145 may include an abrasive structure, a sawtooth pattern, or cutting feature to help cut, dislodge, or otherwise break up the debris 25 that may be stuck above the plug 32. The shroud 146 can also be used to guide a flow of washout fluid 158 to wash out the wellbore 14 in the vicinity of the plug 32. The washout fluid 158 can be pumped downhole through the work string, e.g., through the conveyance 22, through the plug retrieval tool 140 and out a lower end of the plug retrieval tool 140, and up through an annulus 162 between the plug retrieval tool 140 and the casing 18 or interior of the wellbore 14. In one manner of use, the lower end of the shroud 146 may be used to displace the debris 25 with a combination of mechanical agitation via axial and/or rotational movement of the shroud 146 while simultaneously washing out the debris 25 as it is displaced.

FIG. 2B is a schematic side view of the plug retrieval tool 140 with the shroud 146 moved to a retracted position after the debris 25 (of FIG. 2A) has been displaced and washed out of the wellbore 14. The shroud 146 may be moved in a variety of ways, depending on the configuration of the plug retrieval tool 140. In this example configuration, the shroud 146 has been moved to the retracted position by applying a downward force "F" to the mandrel 142. In some cases, the force F may be applied at least in part by setting down weight on the mandrel 142, with the shroud 146 in axial engagement with the top of the plug 32 or other internal wellbore feature. The weight may comprise at least some of the weight of a tool string above the plug retrieval tool 140 to which the mandrel 142 is coupled. This weight can be set down by lowering the plug retrieval tool 140 until the shroud 146 contacts the plug 32 and then releasing at least some tension on the conveyance 22.

The downward movement of the mandrel 142 from its extended position in FIG. 2A to its retracted position in FIG. 2B urges the shroud 146 upward relative to the mandrel 142 (i.e., toward the retracted position). As the shroud 146 moves toward the retracted position, the fluid in the second fluid chamber 154 is constrained to flow from the second fluid chamber 154 to the first fluid chamber 152 through the flow port 156 in the valve plate 153. The flow port 156 may be sized to dampen flow through the flow port 156. The flow port 156 may be defined by on one or more higher-pressure valves to dampen this movement of the shroud 146 to the retracted position. The spring 161 or other biasing member 160 also resist this movement. The spring is compressed, storing force and potential spring energy in axial compression that can be released later to help urge the shroud 146 from the retracted position of FIG. 2B back toward the extended position. The resistance to movement of the shroud 146 allows for the shroud 146 to be axially engaged with the debris even if the shroud is moving toward the retracted position of FIG. 2A.

With the debris having been removed from the plug 32, the plug 32 is now accessible to the retrieval head 144. In particular, the lug 44 in this example is accessible for being latched onto by the retrieval head 144. With the shroud 146 in the retracted position the retrieval head 144 can be positioned close enough to the plug 32 to latch onto it. In this case, the retrieval head 144 is slightly ahead of the lower end 145 of the shroud 146 to facilitate access to the plug 32 by the retrieval head 144. Alternate configurations are possible wherein the lower end 145 of the shroud 146 is still slightly ahead of, or even with, the retrieval head 144 when the retrieval head 144 is close enough to latch onto the lug 44.

FIG. 2C is a schematic side view of the plug retrieval tool 140 wherein the conveyance 22 is being used to raise the plug 32 in the wellbore 14 for retrieval after having removed the plug 32 from the packer 30. With the retrieval head 144 still latched onto the lug 44, the shroud 146 is still in the retracted position with the spring 161 compressed. The retrieval head 144 may release the plug 32 at surface, once removed from the wellbore 14, which may lead to the spring 161 biasing the shroud 146 back to the extended position, ready for a subsequent trip in the event a plug needs to be removed from a wellbore.

Figure 3A:
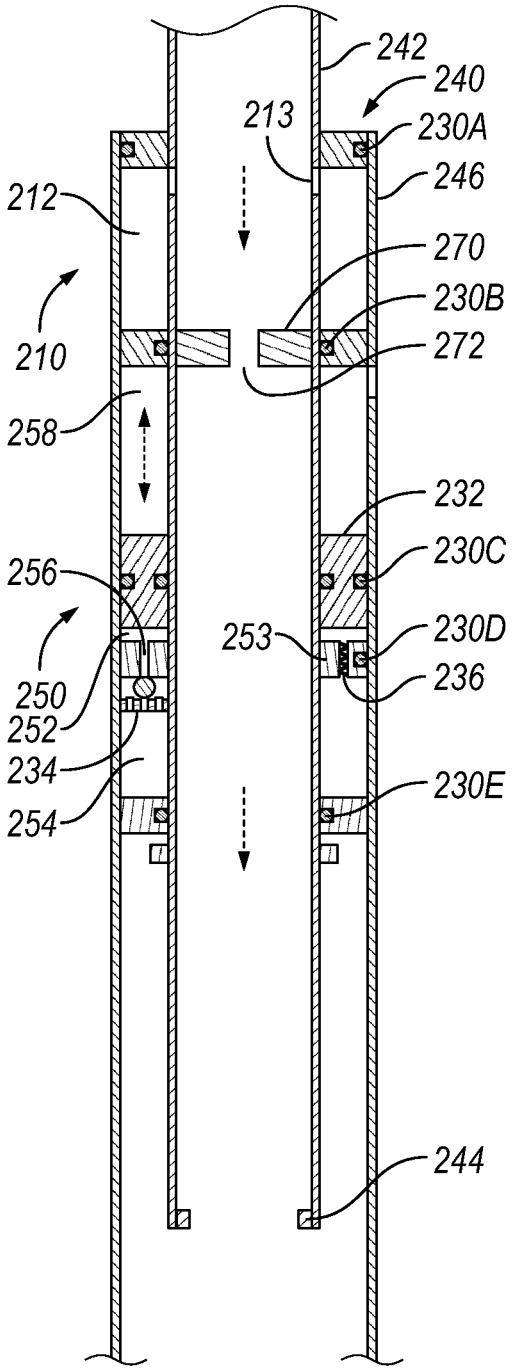
FIG. 3A is a schematic side view of a plug retrieval tool in another example configuration with a hydraulic piston mechanism that has actuated the shroud to the extended position.
Figure 3B:
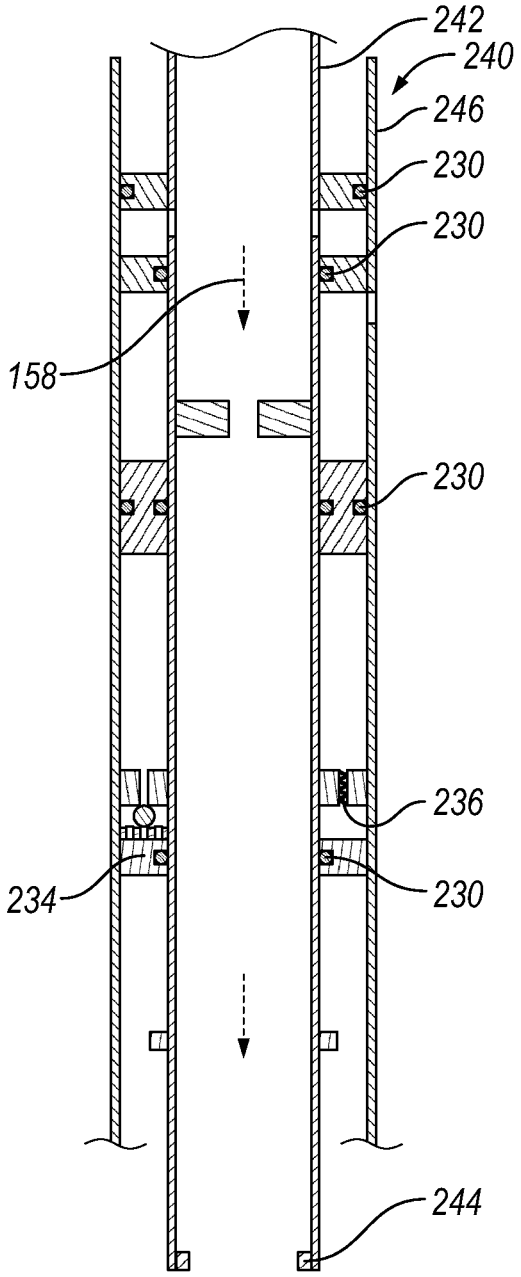
FIG. 3B is a schematic side view of the plug retrieval tool of FIG. 3A with the shroud having been moved to the retracted position.

FIGS. 3A and 3B are schematic side views of a plug retrieval tool 240 according to another example configuration with a hydraulic piston mechanism 210 to actuate the shroud 246. Like the configuration of FIGS. 2A-2C, the plug retrieval tool 240 in FIG. 3A-3B can be operated to remove a plug from a wellbore. For example, the plug retrieval tool 240 includes a shroud 246 telescopically coupled to a mandrel 242 about a retrieval head 244, such that the shroud 246 is moveable repeatedly, as needed, between the extended position (FIG. 3A) for displacing debris and a retracted position (to be discussed in FIG. 3B) for the retrieval head 244 to latch onto the plug 32. The shroud 246 is concentrically disposed around and axially moveable with respect to the mandrel 242, with a splined or keyed interface (not expressly shown) to transfer torque or rotation while allowing this relative axial movement. The hydraulic piston mechanism 210 is used to actuate the shroud 246 to the extended position using flow through the mandrel 242 as further discussed below.

FIG. 3A shows the plug retrieval tool 240 with the shroud 246 in the extended position, as it would be for displacing debris accumulated on a plug. Various annular fluid chambers are defined between the shroud 246 and the mandrel 242. Annular sealing members, e.g., O-rings 230 (individually identified as 230A through 230E) may be used to separate fluid chambers while allowing relative movement between the shroud 246 and the mandrel 242. For example, the resistance mechanism 250 includes first and second, variable-volume fluid chambers 252, 254 defined between the mandrel 242 and shroud 246. A flow port 256 through a valve plate 253 allows constrained flow therebetween. The first fluid chamber 252 is defined between the O-ring 230C on a pressure compensation piston 232 and the O-ring 230D on the valve plate 253. The second fluid chamber 254 is defined between the O-ring 230D and the O-ring 230E below it. As the shroud 246 moves relative to the mandrel 242, fluid flows through the flow port 256 and the relative volumes of the first and second fluid chambers 252, 254 vary accordingly. A pressure compensation chamber 258 is defined between the O-ring 230C on the pressure compensation piston 232 and the O-ring 230B above it. The pressure compensation piston 232 may be in fluid communication with an annulus between the plug retrieval tool 240 and the wellbore to adjust a pressure differential between the first and second fluid chambers 252, 254 in response to a changing annulus pressure. A piston chamber 212 of the hydraulic piston mechanism 210 is defined between the O-ring 230B and the O-ring 230A above it. The various chambers cooperate via fluid pressure and flow to control operation and dynamic behavior of the plug retrieval tool 240.

As with the embodiment of FIGS. 2A-2C, the resistance mechanism 250 may operate in part by controlling the flow of fluid between the fluid chambers 252, 254 through the flow port 256 as the shroud 246 moves relative to the mandrel 242. The flow port 256 may functionally refer to one or a plurality of flow ports through which flow may be controlled by different flow control elements. In this case, the flow control elements include at least one check valve 234 and one metering valve 236. The metering valve meters flow from the second fluid chamber 254 to the first fluid chamber to provide resistance to movement when weight or other force is being applied to the mandrel 242 sufficient to move the shroud toward the retracted position. The check valve requires some threshold amount of pressure to move the shroud 246 back toward the extended position. The pressure compensation chamber 258 is another variable-volume chamber that provides room for thermal expansion of the hydraulic fluid and/or compression of the fluid under hydrostatic pressure.

The piston chamber 212 is in fluid communication with a bore of the mandrel 242 via a fluid inlet, i.e., hydraulic piston port 213 along the mandrel 242. A choke 270 disposed in the bore of the mandrel 242 below the hydraulic piston port 213 provides a resistance to that flow, which may result in a pressure drop across the choke 270 and a corresponding pressure or pressure increase above the choke 270 and at the hydraulic piston port 213. Some of the flow is thereby diverted into the piston chamber 212 to urge the shroud 246 downward relative to the mandrel 242, i.e., toward the extended position. The pressure provided by the piston chamber 212 and corresponding force on the shroud 246 must overcome the resistance provided by the resistance mechanism 250 in order to move the shroud 246 toward the extended position. In particular, the resistance provided by the check valve 234 may lead to a threshold setting force to initiate movement of the shroud toward the extended position. The threshold setting force may help ensure that at lower circulation rates, the pressure differential is sufficiently low that the shroud 246 can be pushed up toward the retracted position. At higher circulation rates, a higher differential pressure overcomes the resistance of the check valve and results in the shroud 246 being pushed down toward the extended position of FIG. 3A. In at least some configurations, a threshold setting force in a range of 10 to 20 kilopounds is particularly effective.

FIG. 3B shows the plug retrieval tool 240 with the shroud 246 having been moved to the retracted position, such as for latching onto or attempting to latch onto a plug. The shroud 246 may be moved from the extended position of FIG. 2A toward the retracted position of FIG. 2B by applying a downward force on the mandrel 242, such as by setting down weight on the plug retrieval tool 240. The metering valve 236 may dampen movement of the shroud 246 toward the retracted position, causing the shroud 246 to move upward relatively slowly. This dampened movement may help maintain a downward force useful for the shroud 246 to displace debris and allow time to wash out the debris prior to reaching the retracted position, whereupon the retrieval head 244 may attempt to latch onto a plug. The flow resistance provided by the check valve 234 may allow the washout fluid 158 to be circulated down through the bore of the mandrel 242 to wash out the wellbore above the plug. The washout fluid 158 may be flowed at a pressure below the threshold pressure of the check valve 234 to avoid inadvertently moving the shroud 246 back toward the extended position. The check valve 234 may be selected to provide a threshold pressure above a useful range for flow of the washout fluid.

Figure 4A:
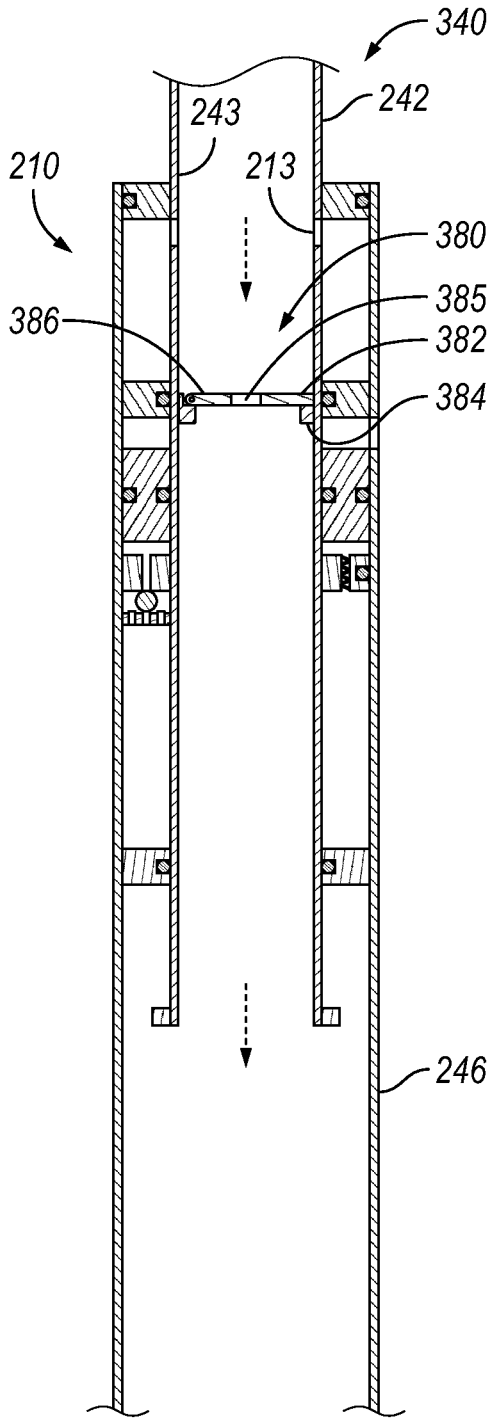
FIG. 4A is a schematic side view of a plug retrieval tool according to an alternate configuration wherein a choke comprises a flapper valve in a closed position.
Figure 4B:
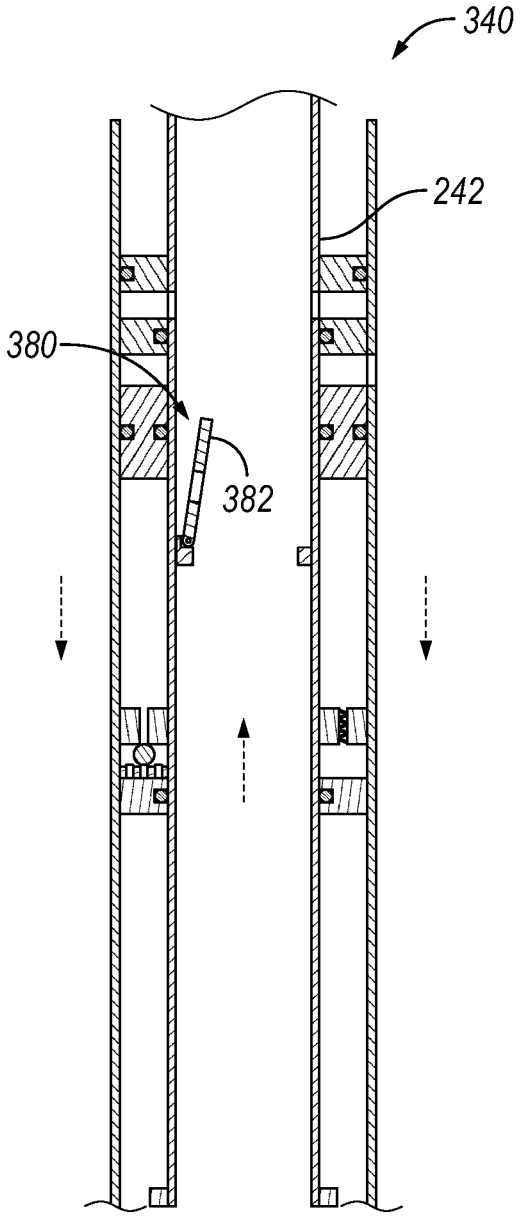
FIG. 4B is a schematic side view of a plug retrieval tool of FIG. 4A with the flapper in an open position.

FIGS. 4A and 4B are schematic side views of a plug retrieval tool 340 according to an alternate configuration wherein a choke comprises a flapper valve 380. The plug retrieval tool 340 is otherwise functionally and structurally the same or similar to the configuration of FIGS. 3A-3B unless otherwise shown or indicated. For example, the hydraulic piston mechanism 210 may be operated to move the shroud 246 with respect to the mandrel 242 to the extended position of FIG. 4A for displacing debris above a plug. The shroud 246 may be moved to the retracted position of FIG. 4B to attempt to latch onto the plug. The shroud 246 may be moved repeatedly between the extended position and the retracted position without having to trip out of the wellbore, in case multiple attempts are required to latch onto the plug.

FIG. 4A shows the plug retrieval tool 340 with the shroud 246 in the extended position. The flapper valve 380 includes a flapper 382 that, in FIG. 4A, is in a closed position against a flapper seat 384. The flapper 386 is disposed in a bore 243 of the mandrel 242 below the hydraulic piston port 213. The flapper 386 is pivotably coupled around a pivot 386 and is moveable about the pivot 386 between the open and closed position. The flapper 386 is moveable in the bore 243 of the mandrel 242 to the closed position and into sealing engagement against the flapper seat 384 in response to circulating a fluid down through the mandrel 242. The flapper 382 in this example also comprises an aperture 385 to allow a restricted flow through the flapper 382 when circulating the fluid down through the mandrel 242. When in the closed position of FIG. 4A, the flapper 382 functions as a choke such as described in relation to FIGS. 3A-3B. Thus, the flapper 382 leads to a pressure drop in response to the flow across the choke to increase pressure through the hydraulic piston port 213. The aperture 385 allows some amount of fluid flow down through the mandrel 242 even with the flapper closed, such as to allow for circulation of a washout fluid.

FIG. 4B shows the plug retrieval tool 340 with the flapper 382 moved to an open position. The flapper 382 may be moved to the open position in response to flow up through the mandrel 242. Flow up through the mandrel 242 may be in response to relative movement between the mandrel 242 and shroud 246 as the shroud 246 is moved toward the retracted position of FIG. 4B. For example, when it is desired to retract the shroud 246, weight may be set down on the piston 242 to urge the shroud 246 up relative to the mandrel 242. In response, the flapper 382 may pivot upwardly to the open position of the mandrel 242 so as to not restrict upward flow and the movement to the retracted position. The upward flow may also be generated or assisted, in some cases, using a reverse circulation.

Figure 5:
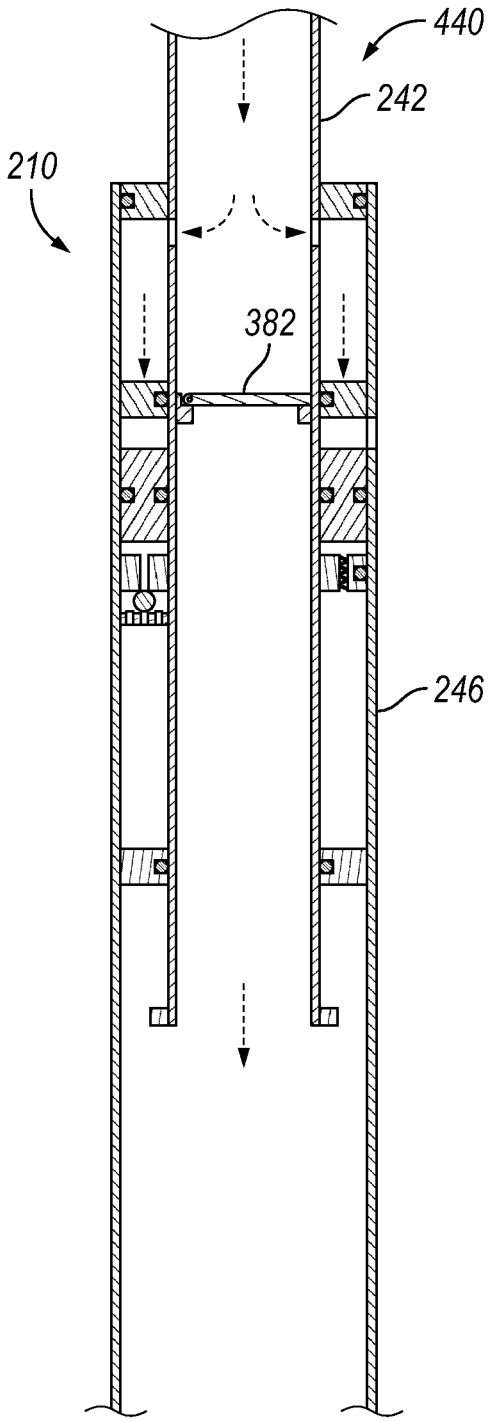
FIG. 5 is a schematic side view of the plug retrieval tool wherein the flapper omits the aperture of FIGS. 4A-4B.

FIG. 5 is a schematic side view of a plug retrieval tool 440 wherein the flapper 382 omits the aperture 385 of FIGS. 4A-4B. Otherwise, the plug retrieval tool 440 is otherwise functionally and structurally the same or similar to the configuration of FIGS. 4A-4B unless otherwise shown or indicated. For example, the hydraulic piston mechanism 210 may be operated to move the shroud 246 with respect to the mandrel 242 to the extended position of FIG. 5 for displacing debris above a plug. With the flapper 382 in the closed position, downward flow through the mandrel 242 is blocked. However, the flapper 382 may be moved to the retracted position to attempt to latch onto the plug, in which case the flapper 382 opens so as to allow flow up through the mandrel 242.

In any of the foregoing embodiments, one or more lower-pressure valves arranged in the valve plate such that flow from the first fluid chamber passes to the second fluid chamber through the lower-pressure valves to provide a lesser resistance when moving the shroud toward the extended position.

The disclosed principles may be applied to methods of retrieving a plug. Such methods may be accomplished using the disclosed examples of a plug retrieval tool or other configurations of a plug retrieval tool within the scope of this disclosure. In at least one example, a method comprises lowering a plug retrieval head into a wellbore on a mandrel with a shroud telescopically coupled to the mandrel about a retrieval head. The shroud is moveable repeatedly between an extended position for displacing debris on a plug and a retracted position for moving the retrieval head closer to the plug. The shroud, when in the extended position, is used to displace debris on the plug using a lower end of the shroud while resisting movement of the shroud to the retracted position on the mandrel. After displacing the debris, the mandrel may be lowered, such as by setting weight down on the sleeve, to move the shroud to the retracted position on the mandrel thereby moving the retrieval head to the plug. An attempt may then be made to latch onto the plug with the retrieval head. Once latched, the plug may be removed from the wellbore on the retrieval head such as by lifting up on the mandrel.

Occasionally, an attempt to latch may fail, such as if efforts to displace and wash out debris is incomplete. The method may further comprise identifying one or more failed attempt to latch onto the plug with the retrieval head. These failed attempts may be identified in a variety of ways, including through direct or indirect inference. For example, if the plug is engaged by the retrieving tool generally there is an upward shear force required to release the plug from the packer. In the case where the plug is not latched and pulled there may be no upward force observed during retrieval efforts. Additional attempts can be made to try and retrieve the plug or the workstring may be pulled to inspect the tools to ensure that the plug has not been latched. With each failed attempt, the mandrel may be raised and the shroud moved back toward the extended position. With the shroud back in the extended position, the shroud may be used to repeat the step of displacing debris on the plug using the lower end of the shroud. The mandrel may be lowered again to move the shroud back to the retracted position to make another attempt to latch onto the plug. Each time the shroud is moved toward the retracted position the movement may be resisted using a restricted fluid flow. Resisting movement of the shroud using the restricted fluid flow may comprise constraining flow from a second fluid chamber to a first fluid chamber through one or more valves in response to moving the shroud toward the retracted position. Moving the shroud back toward the extended position may include generating flow through the mandrel, diverting some of the flow through the mandrel through a fluid inlet (e.g., hydraulic piston port) along a bore of the mandrel into a piston chamber defined between the mandrel and the shroud. A choke along the bore of the mandrel below the fluid inlet may be used to increase a pressure of flow diverted into the piston chamber. The choke may be a fixed choke with an aperture, or a flapper that moves to a closed position to restrict downward flow but moves to an open position to allow upward flow through the mandrel.

Accordingly, the present disclosure may provide tools and methods for retrieving a plug wherein a shroud used to displace debris may be rest without intervention. The tools and methods may include any combination of the various features disclosed herein, including one or more combinations set forth in the following statements.

Statement 1. A plug retrieval tool, comprising: a mandrel lowerable into a wellbore; a retrieval head coupled to the mandrel for selectively latching onto a plug; a shroud telescopically coupled to the mandrel about the retrieval head and moveable repeatedly between an extended position for displacing debris on the plug and a retracted position for moving the retrieval head closer to the plug; and a resistance mechanism providing a resistance to moving the shroud each time the shroud is moved toward the retracted position.

Statement 2. The plug retrieval tool of Statement 1, wherein the resistance mechanism comprises: one or more valves providing the resistance when moving the shroud toward the retracted position and one or more other valves providing the resistance when moving the shroud to the extended position.

Statement 3. The plug retrieval tool of Statement 1 or 2, wherein the resistance mechanism further comprises: first and second fluid chambers defined between the mandrel and the shroud; and a valve plate separating the first and second fluid chambers, with one or more valves arranged on the valve plate such that flow from the second fluid chamber to the first fluid chamber is constrained through the one or more valves when moving the shroud toward the retracted position.

Statement 4. The plug retrieval tool of Statement 3, further comprising: one or more other valves arranged on the valve plate such that flow from the first fluid chamber to the second fluid chamber passes through the one or more other valves when moving the shroud back toward the extended position.

Statement 5. The plug retrieval tool of Statement 3 or 4, further comprising: a pressure compensation piston in fluid communication with an annulus between the plug retrieval tool and the wellbore to adjust a pressure differential between the first and second fluid chambers in response to a changing annulus pressure.

Statement 6. The plug retrieval tool of any of Statements 3 to 5, further comprising: a hydraulic piston including a piston chamber defined between the mandrel and the shroud with a fluid inlet along a bore of the mandrel for urging the shroud to the extended position in response to a flow through the mandrel.

Statement 7. The plug retrieval tool of Statement 6, further comprising: a choke along the bore of the mandrel below the fluid inlet to increase a pressure of the flow through the fluid inlet.

Statement 8. The plug retrieval tool of Statement 7, wherein the choke comprises a flapper valve including a flapper moveable in the bore of the mandrel to a closed position in response to circulating a fluid down through the mandrel and to an open position in response to flow up through the mandrel.

Statement 9. The plug retrieval tool of Statement 8, wherein the flapper comprises an aperture to allow a restricted flow through the flapper when circulating the fluid down through the mandrel.

Statement 10. The plug retrieval tool of any of Statements 1 to 9, wherein the resistance mechanism further comprises a check valve providing a threshold setting force in a range of 10 to 20 kilopounds to initiate movement of the shroud toward the extended position.

Statement 11. The plug retrieval tool of Statement 10, wherein the resistance mechanism further comprises a metering valve to provide at least a portion of the resistance to slow the movement of the shroud to the retracted position.

Statement 12. The plug retrieval tool of any of Statements 1 to 11, wherein the shroud comprises one or both of a mass and a return spring to move the shroud toward the extended position when lifting up on the mandrel.

Statement 13. A plug retrieval tool, comprising: a mandrel lowerable into a wellbore;

a retrieval head coupled to the mandrel for selectively latching onto a plug; a shroud telescopically coupled to the mandrel about the retrieval head and moveable repeatedly between an extended position for displacing debris on the plug and a retracted position for moving the retrieval head closer to the plug; and a resistance mechanism including first and second fluid chambers defined between the mandrel and the shroud, a valve plate separating the first and second fluid chambers, and one or more valves arranged in the valve plate to constrain flow from the second fluid chamber to the first fluid chamber to provide resistance when the shroud is moved toward the retracted position.

Statement 14. The plug retrieval tool of Statement 13, further comprising one or more lower-pressure valves arranged in the valve plate such that flow from the first fluid chamber passes to the second fluid chamber through the lower-pressure valves to provide a lesser resistance when moving the shroud toward the extended position.

Statement 15. The plug retrieval tool of Statement 13 or 14, further comprising: a hydraulic piston including a piston chamber defined between the mandrel and the shroud with a fluid inlet along a bore of the mandrel for urging the shroud to the extended position in response to flow through the mandrel; and a choke along the bore of the mandrel below the fluid inlet to increase a pressure of flow through the fluid inlet.

Statement 16. The plug retrieval tool of any of Statements 13 to 15, wherein the one or more valves comprise one or both of a check valve providing a threshold setting force to initiate movement of the shroud toward the extended position and a metering valve to provide at least a portion of the resistance to slow the movement of the shroud to the retracted position.

Statement 17. A method comprising: lowering a plug retrieval head into a wellbore on a mandrel with a shroud telescopically coupled to the mandrel about the retrieval head, the shroud moveable repeatedly between an extended position for displacing debris on a plug and a retracted position for moving the retrieval head closer to the plug; with the shroud in the extended position, displacing debris on the plug using a lower end of the shroud while resisting movement of the shroud to the retracted position on the mandrel; after displacing debris, lowering the mandrel to move the shroud to the retracted position on the mandrel thereby moving the retrieval head to the plug; latching onto the plug with the retrieval head; and removing the plug from the wellbore on the retrieval head.

Statement 18. The method of Statement 17, further comprising: identifying one or more failed attempt to latch onto the plug with the retrieval head; with each failed attempt, raising the mandrel, moving the shroud back toward the extended position, further displacing debris on the plug using the lower end of the shroud, and lowering the mandrel to move the shroud back to the retracted position; and resisting movement of the shroud using a restricted fluid flow each time the shroud is moved toward the retracted position.

Statement 19. The method of Statement 18, wherein resisting movement of the shroud using the restricted fluid flow comprises constraining flow from a second fluid chamber to a first fluid chamber through one or more valves in response to moving the shroud toward the retracted position.

Statement 20. The method of Statement 18 or 19, wherein moving the shroud back toward the extended position comprises: generating flow through the mandrel; diverting some of the flow through the mandrel through a fluid inlet along a bore of the mandrel into a piston chamber defined between the mandrel and the shroud; and using a choke along the bore of the mandrel below the fluid inlet to increase a pressure of flow diverted into the piston chamber.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A plug retrieval tool, comprising:

a mandrel lowerable into a wellbore;

a retrieval head coupled to the mandrel for selectively latching onto a plug;

a shroud telescopically coupled to the mandrel about the retrieval head and moveable repeatedly between an extended position for displacing debris on the plug and a retracted position for moving the retrieval head closer to the plug; and a resistance mechanism providing a resistance to moving the shroud each time the shroud is moved toward the retracted position, wherein the resistance mechanism comprises one or more valves providing the resistance when moving the shroud toward the retracted position and one or more other valves providing the resistance when moving the shroud to the extended position.

2. The plug retrieval tool of claim 1, wherein the resistance mechanism further comprises:

first and second fluid chambers defined between the mandrel and the shroud; and a valve plate separating the first and second fluid chambers, with one or more valves arranged on the valve plate such that flow from the second fluid chamber to the first fluid chamber is constrained through the one or more valves when moving the shroud toward the retracted position.

3. The plug retrieval tool of claim 2, further comprising:

one or more other valves arranged on the valve plate such that flow from the first fluid chamber to the second fluid chamber passes through the one or more other valves when moving the shroud back toward the extended position.

4. The plug retrieval tool of claim 2, further comprising:

a pressure compensation piston in fluid communication with an annulus between the plug retrieval tool and the wellbore to adjust a pressure differential between the first and second fluid chambers in response to a changing annulus pressure.

5. The plug retrieval tool of claim 2, further comprising:

a hydraulic piston including a piston chamber defined between the mandrel and the shroud with a fluid inlet along a bore of the mandrel for urging the shroud to the extended position in response to a flow through the mandrel.

6. The plug retrieval tool of claim 5, further comprising:

a choke along the bore of the mandrel below the fluid inlet to increase a pressure of the flow through the fluid inlet.

7. The plug retrieval tool of claim 6, wherein the choke comprises a flapper valve including a flapper moveable in the bore of the mandrel to a closed position in response to circulating a fluid down through the mandrel and to an open position in response to flow up through the mandrel.

8. The plug retrieval tool of claim 7, wherein the flapper comprises an aperture to allow a restricted flow through the flapper when circulating the fluid down through the mandrel.

9. The plug retrieval tool of claim 1, wherein the resistance mechanism further comprises a check valve providing a threshold setting force in a range of 10 to 20 kilopounds to initiate movement of the shroud toward the extended position.

10. The plug retrieval tool of claim 9, wherein the resistance mechanism further comprises a metering valve to provide at least a portion of the resistance to slow the movement of the shroud to the retracted position.

11. The plug retrieval tool of claim 1, wherein the shroud comprises one or both of a mass and a return spring to move the shroud toward the extended position when lifting up on the mandrel.

12. A plug retrieval tool, comprising:

a mandrel lowerable into a wellbore;

a retrieval head coupled to the mandrel for selectively latching onto a plug;

a shroud telescopically coupled to the mandrel about the retrieval head and moveable repeatedly between an extended position for displacing debris on the plug and a retracted position for moving the retrieval head closer to the plug; and a resistance mechanism including first and second fluid chambers defined between the mandrel and the shroud, a valve plate separating the first and second fluid chambers, and one or more valves arranged in the valve plate to constrain flow from the second fluid chamber to the first fluid chamber to provide resistance when the shroud is moved toward the retracted position.

13. The plug retrieval tool of claim 12, further comprising one or more lower-pressure valves arranged in the valve plate such that flow from the first fluid chamber passes to the second fluid chamber through the lower-pressure valves to provide a lesser resistance when moving the shroud toward the extended position.

14. The plug retrieval tool of claim 12, further comprising:

a hydraulic piston including a piston chamber defined between the mandrel and the shroud with a fluid inlet along a bore of the mandrel for urging the shroud to the extended position in response to flow through the mandrel; and a choke along the bore of the mandrel below the fluid inlet to increase a pressure of flow through the fluid inlet.

15. The plug retrieval tool of claim 12, wherein the one or more valves comprise one or both of a check valve providing a threshold setting force to initiate movement of the shroud toward the extended position and a metering valve to provide at least a portion of the resistance to slow the movement of the shroud to the retracted position.

16. A method comprising:

lowering a plug retrieval head into a wellbore on a mandrel with a shroud telescopically coupled to the mandrel about the retrieval head;

with the shroud in an extended position, displacing debris on the plug using a lower end of the shroud while resisting movement of the shroud to the retracted position on the mandrel;

after displacing debris, lowering the mandrel to move the shroud to a retracted position on the mandrel thereby moving the retrieval head to the plug;

latching onto the plug with the retrieval head;

identifying one or more failed attempt to latch onto the plug with the retrieval head;

with each failed attempt, raising the mandrel, moving the shroud back toward the extended position, further displacing debris on the plug using the lower end of the shroud, and lowering the mandrel to move the shroud back to the retracted position;

resisting movement of the shroud using a restricted fluid flow each time the shroud is moved toward the retracted position; and removing the plug from the wellbore on the retrieval head.

17. The method of claim 16, wherein resisting movement of the shroud using the restricted fluid flow comprises constraining flow from a second fluid chamber to a first fluid chamber through one or more valves in response to moving the shroud toward the retracted position.

18. The method of claim 16, wherein moving the shroud back toward the extended position comprises:

generating flow through the mandrel;

diverting some of the flow through the mandrel through a fluid inlet along a bore of the mandrel into a piston chamber defined between the mandrel and the shroud; and using a choke along the bore of the mandrel below the fluid inlet to increase a pressure of flow diverted into the piston chamber.

* * * * *